United States Patent [19]

Olsson

[11] 3,976,117

[45] Aug. 24, 1976

[54] METHOD OF AND APPARATUS FOR CONVERTING MOLTEN METAL INTO A SEMI-FINISHED OR FINISHED PRODUCT

[76] Inventor: Erik Allan Olsson, Oerlikonerstrasse 88, Zurich, Switzerland

[22] Filed: Aug. 13, 1975

[21] Appl. No.: 604,430

[30] Foreign Application Priority Data

Nov. 17, 1974 Switzerland ..... 14657/74
Nov. 17, 1974 Switzerland ..... 14659/74

[52] U.S. Cl. ..... 164/48; 164/87; 164/250; 164/281 H

[51] Int. Cl.[2] ..... B22D 27/02; B22D 11/06

[58] Field of Search ..... 164/48, 49, 87, 88, 164/273 R, 250, 281

[56] References Cited

UNITED STATES PATENTS

| | | | |
|---|---|---|---|
| 3,463,365 | 8/1969 | Dumont-Fillon | 164/281 X |
| 3,605,865 | 9/1971 | Getselev | 164/281 X |

*Primary Examiner*—Travis S. McGehee
*Attorney, Agent, or Firm*—Parmelee, Miller, Welsh & Kratz

[57] ABSTRACT

Molten metal, and particularly molten steel, is continuously converted into a thin strip or strand having the fine grain structure that is found in the thin layer of metal that exists at the surface of a cast ingot where the metal in contact with the cold mold wall solidifies rapidly, and which is sometimes designated the chill layer. The molten metal is contained in a refractory vessel having an open face which is covered in part or entirely by a continuously-moving cold member against which the molten metal solidifies and by which it is carried out of contact with the molten metal in the vessel, the molten metal in the vessel being replenished as it is removed in this manner. Contact between the moving cold surface and the molten metal is effected or controlled in some manner by utilizing the field generated about a conductor energized from an alternating current field to repel a non-magnetic conductor, which includes molten metal. This phenomenon is used to raise the level of molten metal in a vessel, to control its descent from the down leg of a syphon, or confine the escape of molten metal from a discharge terminal and like operations, including using multi-phase alternating currents to moderate the flow of metal in opposition to gravity.

24 Claims, 17 Drawing Figures

METHOD OF AND APPARATUS FOR CONVERTING MOLTEN METAL INTO A SEMI-FINISHED OR FINISHED PRODUCT

This invention is for an improvement in the invention disclosed in my copending application Ser. No. 604,428 filed concurrently with this application and which, so far as it is relevant, is incorporated herein by reference.

For nearly a century patents and various trade publications have disclosed in various forms the concept of converting molten metal directly from the molten state into thin flat finished or semi-finished products and thereby avoid the requirement for extensive ingot or billet casting with the subsequent hot and cold rolling operations for reducing the casting to a finished or semi-finished product. Much of the many rolling stages are necessary in order to break down the coarser grain structure that forms in an ingot or slab because after the first quick chilling of the molten metal in contact with the mold walls, resulting in a fine grain structure, subsequent solidification takes place inwardly toward the center at an increasingly slower rate. With the slower rate of cooling the metal crystals are larger and the composition becomes less uniform from the outside toward the center.

Notwithstanding the various patents and other technical disclosures proposing to form a finished product directly from molten metal, little actual commercial production, especially with steel and ferrous alloys, as well as other important metals, has been achieved for various reasons. One serious difficulty arises from the formation of fins or flash which develop where the molten metal solidifies along the edges of the casting as it forms on a moving cold surface. This causes tearing of the metal which is solidifying as it is being carried along by the moving surface by the already solidified fins or flash. Also, because the molten metal has sometimes been poured on a traveling chill surface expecting it to spread out evenly and the metal which first hits the cold surface solidifies, the product is uneven and non-uniform.

In my said copending application there is disclosed a method and apparatus wherein molten metal is prevented from entering a space or crevice into which it might otherwise flow by positioning a conductor that is connected in series with an alternating current source in such proximity to said space or crevice as to repel the molten metal from entering the space, the invention being based on the phenomenon that the field generated by an alternating current will repel a non-magnetic conductor, such as molten ferrous metal and ferrous alloys.

The present invention utilizes this same phenomenon in a process where molten metal is applied to a moving cold or chill surface to regulate in some manner the transfer of molten metal to the moving surface and even impart controlled directional flow to the metal or control the thickness or width, or both, of the casting which is formed, often at the same time the metal is restrained from flowing into some crevice or other opening which it should not enter, as disclosed in the copending application.

According to this invention, a conductor may be placed around a container for molten metal to raise the level of the metal in the container above the vessel walls where it forms a meniscus produced by surface tension above the walls of the container at a level where a moving chill surface skimming the top of the molten metal will accumulate a thin layer which solidifies on the chill surface to be subsequently stripped from the chill surface or permanently fused thereto, depending on the purpose for which the process is carried out. The chill surface may comprise a traveling belt or the under surface of a peviously-formed layer of similar metal to form a layer on a layer, or it may be the surface of a rotating roll against which the molten metal is brought to bear. Alternatively the vessel may be a vertical vessel with a bottom opening over the upper surface of a moving chill surface, such as above described, where the molten metal flows downwardly onto the moving surface, and the conductor regulates or controls the downward flow. Moreover such vessel may be the down leg of a syphon where the alternating current field works in conjunction with barometric pressure to control or restrict down-flow of metal. The field generated by the conductor may control the thickness of the solid layer of metal so formed and restrain the molten metal from leaving the vessel with the solidified metal. Additionally, the field may be generated by a succession of closely-spaced conductors energized from a polyphase alternating current to induce the flow of molten metal either up or down an inclined surface to thereby regulate the thickness of a deposited layer of metal, where, for example, the chill surface is moving upgrade and a longer or shorter pool of molten metal on the chill surface increases or decreases the time that the metal in the pool contacts the moving chill surface.

These, and other examples, are disclosed and hereinafter described more fully in connection with the accompanying schematic drawings wherein.

Figure 8:
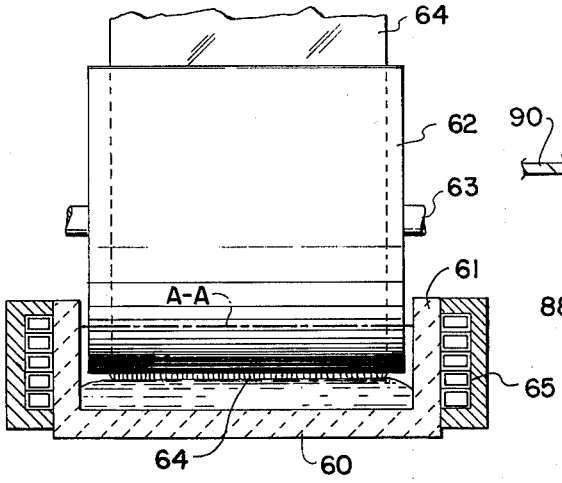
Figure 11:
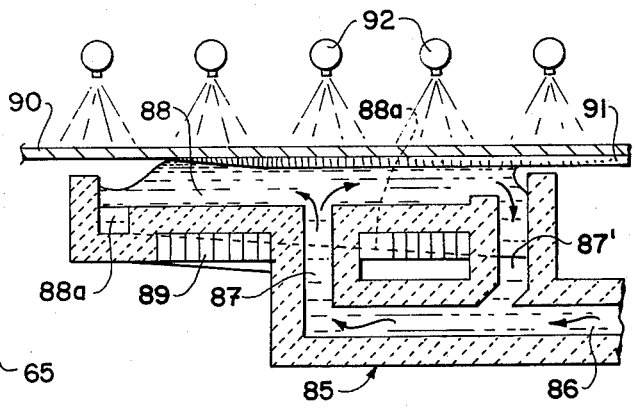
Figure 9:
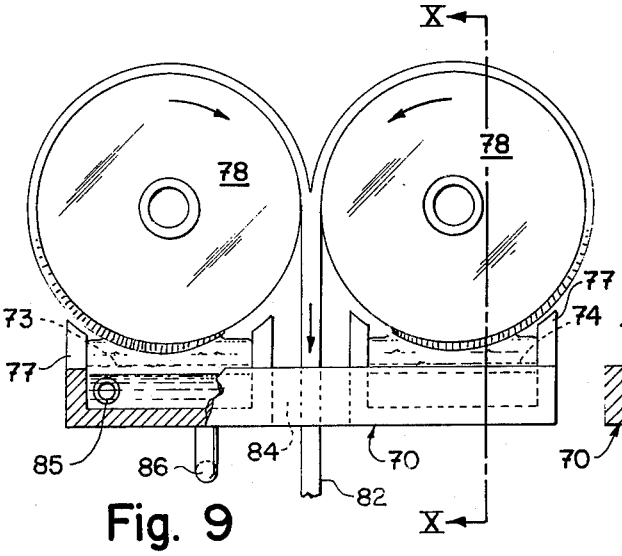
Figure 10:
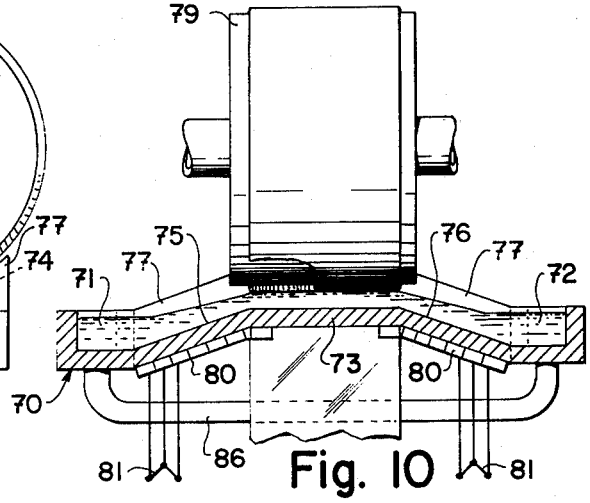
Figure 12:
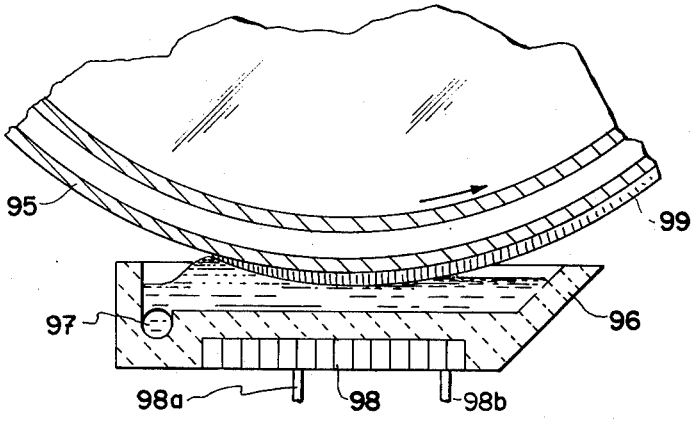
Figure 13:
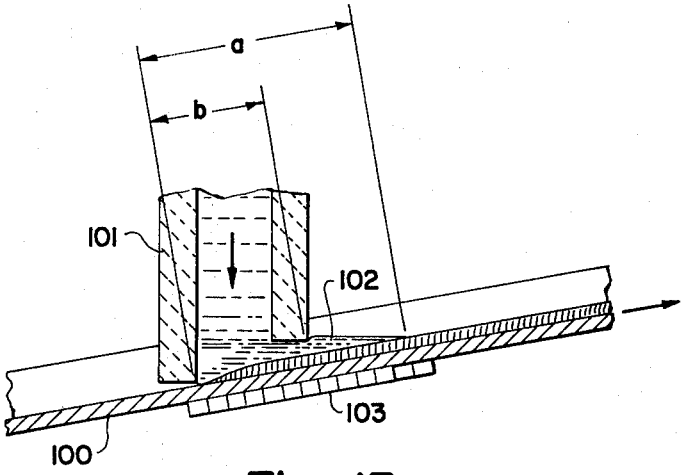
Figure 14:
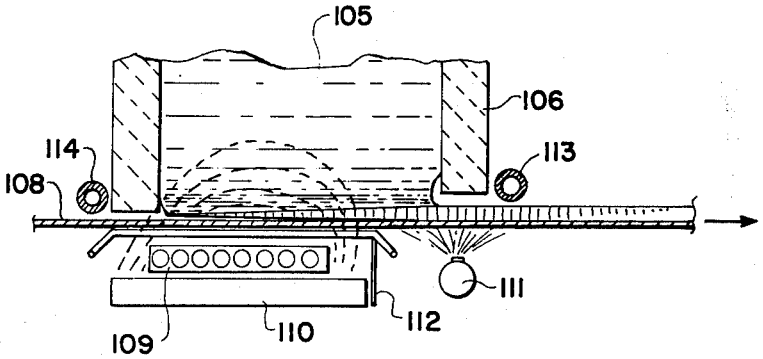
Figure 15:
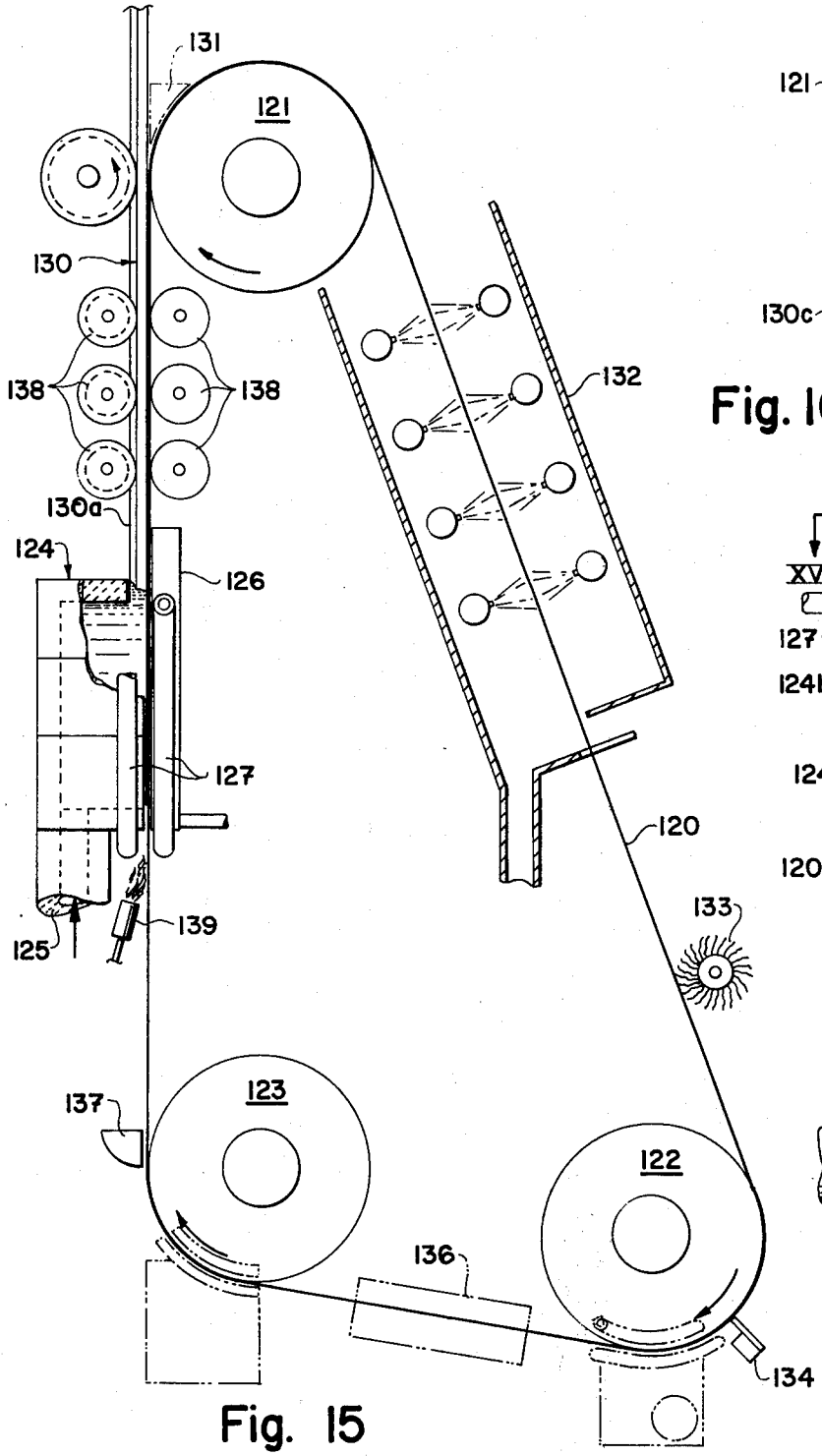
Figure 16:
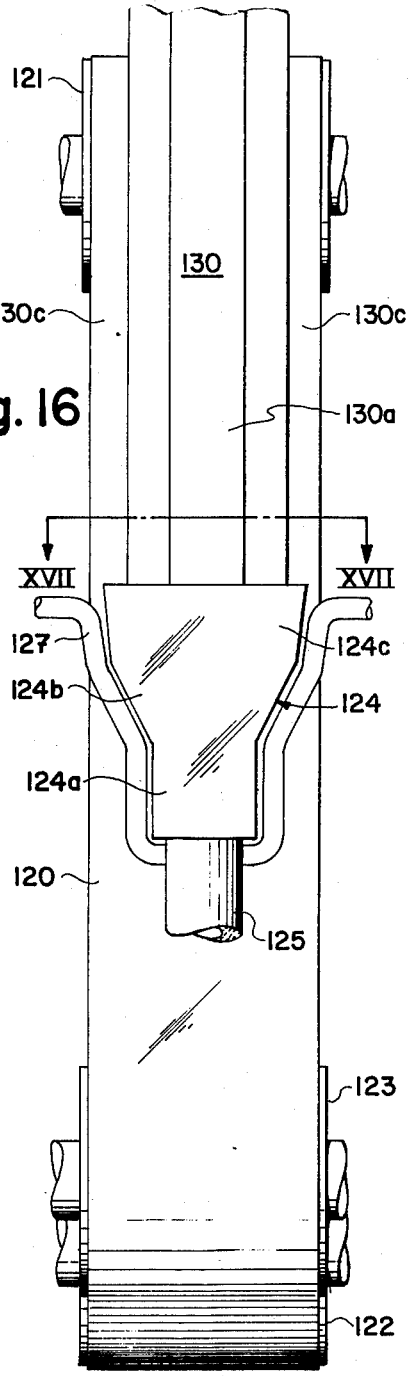
Figure 17:
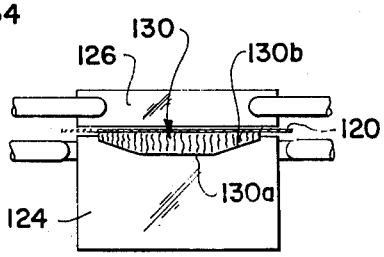

FIG. 8 is a transverse section through a casting apparatus wherein the molten metal is deposited on the surface of a traveling element, here shown as a rotating roll, that dips into a vessel in which a uniform depth of molten metal is maintained so that a layer of metal forms on the cold surface. A similar apparatus is more fully disclosed in my copending application above referred to, but in this case the magnetic field not only prevents the metal from flowing between the ends of the roll and the side walls as described in said application, but also within limits which control the width of the layer of metal that forms on the roll or rolls, or other continuously-traveling element, the surface of which dips into the molten metal;

FIG. 9 is a schematic side elevation of a casting unit having two parallel dip rolls, each of which contacts molten metal on an elevated structure to which molten metal is raised from a peripheral trough up inclined ramps parallel with the roll axes by action of a polyphase alternating current;

FIG. 10 is a transverse section in the plane of line XI—XI of FIG. 9 with the roll in the plane of the section however being shown in elevation;

FIG. 11 is a schematic longitudinal section through a portion of a casting apparatus where molten metal is applied to the under surface of a moving web of belt providing a chill surface on which molten metal congeals, there being a shallow vessel to which molten metal is supplied and a pancake type coil for urging the molten metal up against the moving chill surface;

FIG. 12 is for another form of apparatus where the chill surface is curved, such as might be provided by a roll or perhaps a portion of a traveling belt with a pancake type of coil under a molten metal-holding receptacle;

FIG. 13 represents a longitudinal section where the liquid metal is deposited on the upper surface of an inclined traveling chill surface beneath which there is a multiphase winding located under the chill surface to be energized by a polyphase alternating current, said winding being energized to induce the flow of metal up or down the inclined chill surface to increase or decrease respectively the time interval during which the molten metal is in contact with the traveling chill surface;

FIG. 14 is a diagram showing how the solidifying metal may be held spaced above the traveling chill surface for a short period of time to prevent the molten metal from freezing tightly onto the chill surface;

FIG. 15 is a schematic side elevation of a casting apparatus where the molten metal is cast and solidifies on a vertically-moving endless belt of some type, and disclosing also a method and apparatus wherein the strand being formed has thicker and thinner portions;

FIG. 16 is a front elevation of the casting apparatus shown in FIG. 15; and FIG. 17 is a transverse section in the plane of line XVII—XVII of FIG. 16 showing how the casting may be thinner at its edges.

Figure 1:
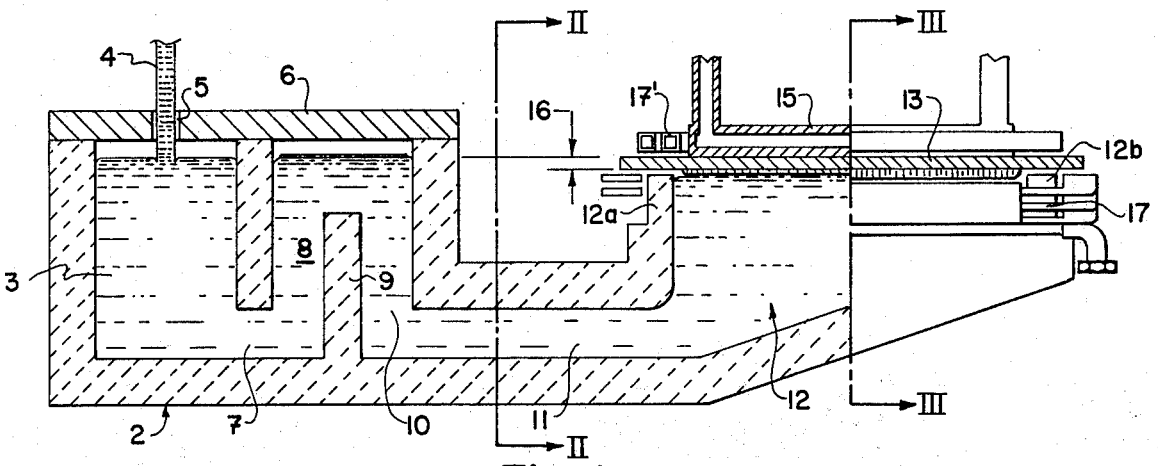
FIG. 1 is a view partly in transverse section and partly in elevation of a continuous sheet or strip casting apparatus.
Figure 2:
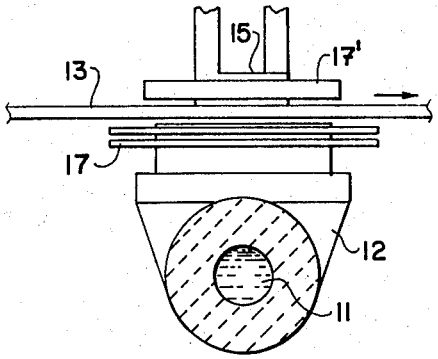
FIG. 2 is an end elevation of the apparatus of FIG. 1.

Referring to the drawings, FIGS. 1 and 2 disclose the manufacture of flat strands, particularly from molten steel. Such strands may comprise narrow strips or sheet bars or wide flat strips. There is a refractory vessel, designated generally as 2 with a well portion 3 into which molten metal is discharged from a ladle (not shown), the numeral 4 indicating the incoming metal entering through an opening 5 in a cover 6.

The well has an outlet 7 at its bottom opening into a vertical passage 8 formed in part by a baffle 9 over which the molten metal flows into a descending passage 10 at the other side of the baffle. A horizontal passage 11 leads from the lower end of this passage to a trough-like compartment 12 at the opposite end of the passage which may be termed a font, or, perhaps, a tundish because it is from the trough that molten metal is removed to become a casting. The long dimension of the trough is from left to right in FIG. 1 and normal to the plane of the paper in FIGS. 2 and 3.

Figure 3:
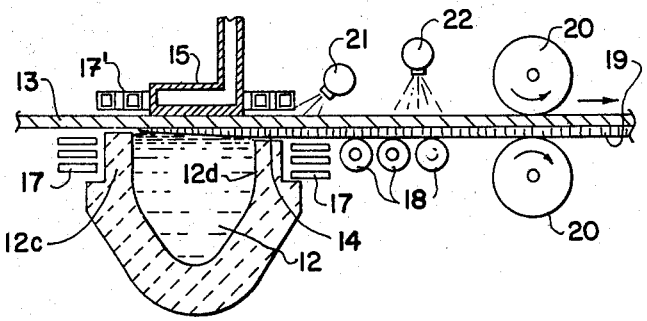
FIG. 3 is a section in the plane of line III—III of FIG. 1 looking toward that end of the unit shown in FIG. 2.

There is a traveling cold element 13 covering the top of the tundish. This may be an endless belt, a cooled roll, or some other element providing a moving chill surface. As here shown it is a flat run of a continuously-moving endless belt, only a portion of which is shown in the drawings. It travels in the direction of the arrow in FIGS. 2 and 3 and its width is slightly wider than the longest dimension of the trough-like tundish so that its edges lap over walls **12*a* and 12*b* which are of the same height. In FIGS. 2 and 3 the other walls of the tundish, at right angles to walls 12*a* and 12*b* are walls 12*c* and 12*d*, the former being on the approach side of the tundish and the latter on the exit side. Wall 12*c* of the tundish terminates at the same level as 12*a* and 12*b*, but the top of wall 12*d* is below the level of the others and is spaced below the belt 13, this space being indicated at 14 in FIG. 3. It opens in the exit direction of the belt 13**.

There is a water-cooled shoe 15 bearing aginst the top of the belt 13 to accelerate solidification of the molten metal and to maintain the proper relation of the belt relative to the wall edges. It has water inlet and outlet connections, as indicated.

The level of molten metal in the well 3 during operation is higher than the level of the top of walls **12*a* 12*b* and 12*c*, so that the molten metal in the tundish seeking the same level rises against the lower surface of the traveling belt 13 so that it solidifies as a thin layer on the traveling cold surface and is wiped away from the underlying molten metal forming the fine grain structure characteristic of the initial or chill layer of metal in a cast ingot or billet. The difference in the level of the metal in the well 3 and lower surface of the belt is indicated at 16 in FIG. 1. The thickness of the solidified layer or strand depends on the width of the tundish and the speed of travel of the surface 13 and the effectiveness of the cooling. The solidification of the molten metal on the under surface of the chill member 13 requires clearance for the member 13 and the attached solidified metal at the exit side of the tundish. This is the reason the wall 12*d* of the tundish is at a level below the level of the other three walls, 12*a*, 12*b* and 12*c*. This clearance must be adequate for the maximum layer thickness that is removed on the moving chill surface and with thicker layers of metal, the metal on the lower surface may even be semi-solid. Conductors 17 on the upper portion of the tundish energized with alternating current are arranged, first across the front of the clearance space above described to hold back the flow of any liquid metal through this space, but does not interfere with the upward pressure of the molten metal against the moving chill surface, and second it serves to exclude the escape of metal around the top of the tundish under the moving surface where the surface tension of the metal is not adequate to prevent outflow over the edges 12*a*, 12*b* and 12*c*. The winding 17** may have two sections for this with one common central terminal as indicated, and upper and lower separate terminals, the lower one being shown as comprising also a water inlet coupling to indicate that the convolutions of the conductor may be water-cooled.

Alternative to the upper section of the conductor or in addition thereto there may be a conductor 17' of one or more turns above the traveling chill surface around the cooling shoe 15 directly over the vertical walls of the tundish to repel the outflow of metal over the top of the tundish, but which will not repel the metal in the tundish from adequately contacting the traveling cold element 13. For this reason the traveling cold element 13 should not be magnetic, or only very mildly so, as otherwise it would absorb too much of the energy from the conductor 17'. This conductor is indicated as being hollow for the circulation of cooling water or other fluid therethrough.

There are water-cooled rollers indicated at 18 over which the traveling member 13 with the adhering metal layer or film 19 moves to provide cooling of any metal not completely solidified before the combined carrier or belt 13 and the attached layer of metal passes between rolls 20 which support the belt and apply tension. Water or other fluid sprays are indicated at 21 and 22. They are directed against the top or reverse surface of the carrier 13. Directing liquid onto the under surface, especially if the added layer of metal 19 is not fully solidified, would be likely to damage the surface of said layer and cause an undesirable hydrogen pick-up.

Unless the element 13 on which the layer of metal so formed is to be permanently combined with or laminated with the added layer 19, the two are separated by means (not shown) after passing between rolls 20. Often a release agent is applied to the surface of the chill surface before it moves into contact with the molten metal to facilitate subsequent separation, as is well understood in the art.

Figure 4:
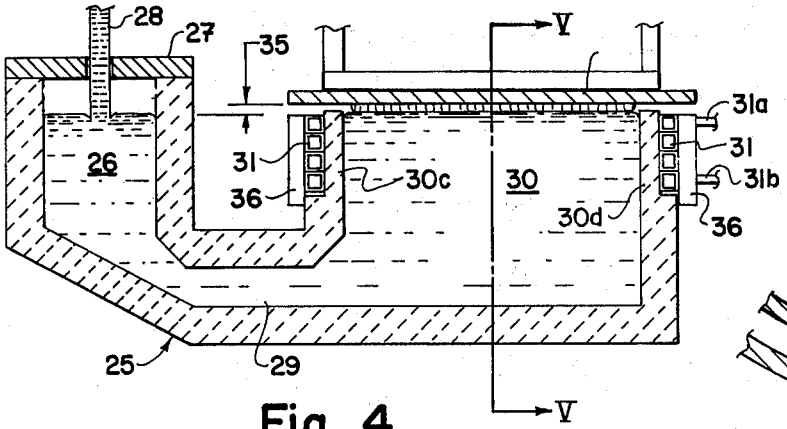
FIG. 4 is a view similar to FIG. 1 wherein an electromagnetic field is used to elevate the surface of the metal in the casting apparatus against a moving surfce on the underside of which a layer of metal is to be deposited.
Figure 5:
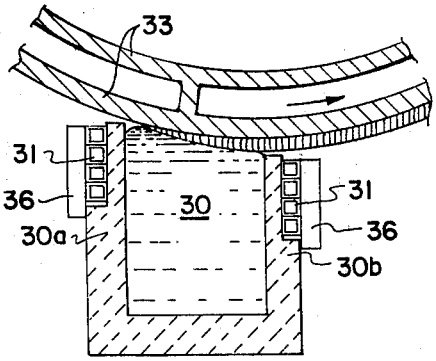
FIG. 5 is a transverse section in the plane of line V—V of FIG. 4 but with a chilled roll providing the cold surface onto which a film or layer of molten metal is to be deposited instead of a flat body as in FIG. 4.

In FIGS. 4 and 5 there is disclosed a modification of the method and apparatus shown in FIGS. 1 and 2, and FIG. 5 furthermore is a modification of FIG. 4 in that it shows how the periphery of a roll may provide a traveling chill surface onto which a thin layer of molten metal is solidified.

In FIGS. 4 and 5 there is a refractory body 25 having a well 26 at one end with a cover 27 through which a stream of molten metal 28 keeps the level of molten metal in the wall at a substantially constant level. A channel 29 leads from the bottom of this well to a trough-like compartment 30, which, like compartment 12 in FIG. 1, is a font or tundish having parallel side walls 30*a* and 30*b* and parallel end walls 30*c* and 30*d*, the upper portions of these walls being reduced in thickness on the exterior and side wall 30*b* like 12*d* in FIG. 3, terminating below the level of the other three walls.

The upper portions of all of the walls which are of reduced thickness support several convolutions of a conductor 31 extending downward from the level of the tops of the several walls to a level intermediate the tops and bottom. Terminals, which may also be couplings for coupling the conductor into a water or other fluid-cooling system (not shown) as well as for connecting the conductor in series with an alternate current source (not shown) are indicated at 31*a* and 31*b*.

The cover for the tundish shown in FIG. 4 is an endless belt 37 as disclosed in FIGS. 1 to 3 extending across and lapping over the end walls 13*c* and 13*d* of the tundish, the belt traveling in a direction normal to the plane of the paper on which the drawing is made, and it is shown in transverse section. FIG. 5 shows the same refractory body as FIG. 4 but the tundish is shown in a section in about the plane of line V—V of FIG. 4. It is covered by a portion of the periphery of a driven roll 33, and the curvature of the roll surface may provide adequate clearance so that wall 30*b* could be the same height as the other walls, or nearly the same. This roll, which may be water-cooled, provides a traveling chill surface on which the molten metal will congeal as a thin layer and from which this layer will be stripped.

It will be noted by reference to the dimension 35 indicated at 16 in FIG. 4 that the level of the metal in the well 26 is below the level of the metal in the tundish. This is because the field generated by the conductor 31 repels the metal inwardly from the vertical walls and correspondingly raises the meniscus forming the top of the molten metal against the belt 32 or the periphery of the roll 33, while at the same time the field generated by the conductor keeps the metal from overflowing the top of the tundish, as explained in FIGS. 1 to 3. Also the water-cooled cooling shoe, sprays and other accessories as described in FIGS. 1 to 3 may be used.

In FIGS. 4 and 5 there is shown a magnetic yoke 36 for confining the field around the conductor 31 and reducing energy loss through induced stray currents. Also sheets of magnetic steel may be used in place of or in some cases in addition yokes 36 in any of the several modifications herein disclosed to partially enclose the conductors and confine the magnetic field and loss of energy to other parts of the apparatus.

Instead of depositing a layer of metal upward against the underface of a traveling chill element as in FIGS. 1 to 5, the molten metal may be supplied downwardly onto the top surface of the traveling chill element to continuously form a layer of solidified metal thereover that is subsequently stripped from the chill surface except where it is to be permanently laminated or fused to the chill layer, as for example, where a casting of multiple layers fused together is to be formed. In such case each layer may be applied and fused to a previously-formed layer with the previously-formed layer or layers comprising a traveling chill surface.

Figure 6:
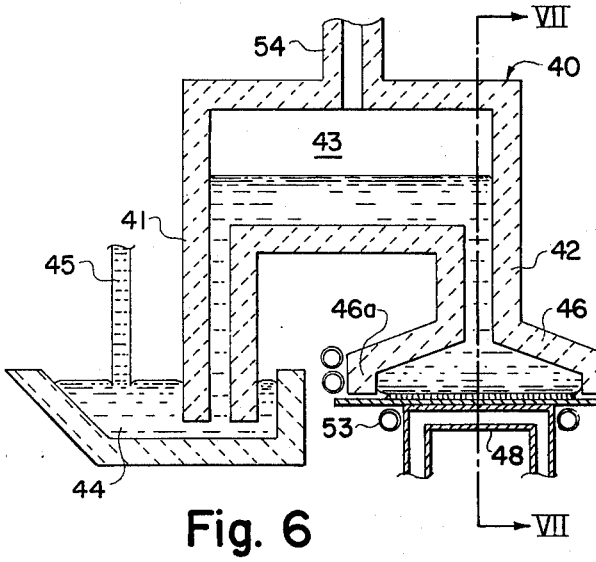
FIG. 6 is a section through a casting apparatus in which molten metal is deposited on the upper surface of a moving chill surface instead of the lower surface, as in the previous figures, the view being transverse to the direction of travel of the chill surface.
Figure 7:
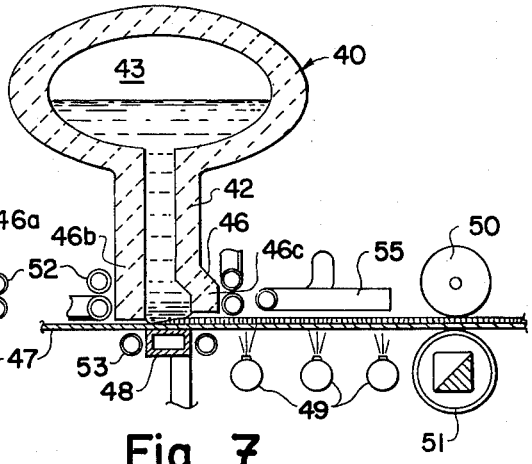
FIG. 7 is a section in the plane of line VII—VII of FIG. 6.

FIGS. 6 and 7 disclose an apparatus and method for applying the molten metal to the top surface of the traveling chill element. In these figures 40 designates generally a refractory or refractory-lined syphon having a riser leg 41 and a down or discharge leg 42, the upper ends of the two legs each opening into a cross-over passage 43.

The riser leg as here shown dips into a vessel 44 which is supplied with molten metal from a ladle or other source (not shown) but 45 designates the incoming supply of molten metal from said source. The supply is regulated to the rate of removal so that the lower end of riser leg 41 is always immersed in molten metal. While a syphon is here shown, the riser leg could be the longer and terminate in a pressure vessel from which the molten metal would be forced by gas pressure up the riser to the down leg. The lower portion of the down leg 42 is in the form of an enlarged discharge terminal 46. It is positioned over a traveling chill member 47 which provides a continuously-moving chill surface under the discharge terminal. This surface may be an endless belt as above described, or the top of a water-cooled roll, or perhaps a long thin strip of metal which, for example, could be supplied from one reel (not shown) and wound up on another reel, or cut into lengths after passing beyond the apparatus here shown. The chill element 47 illustrated in the drawings is of a width to lap under the lower edges 46*a* of the discharge terminal. The edges 46*b* and 46*c* (FIGS. 7) which extend crosswise of the member 47 terminate above the top surface of said traveling chill member 47. The edge portion 46*b* on the approach side of the terminal just clears the chill surface, but edge portion 46*c*, which is on the exit side of the discharge terminal, is spaced above the top of 47 a distance sufficient to clear member 47 and the layer of metal deposited on it, up to the maximum thickness of such layer.

There is a water-cooled shoe or plate 48 below the discharge terminal 46 on which the traveling belt or chill member 47 is supported, and over which it moves. Beyond this in the direction of travel of the chill member cooling sprays 49 are shown under the chill member for cooling it, and beyond these is a pair of rolls 50 arranged to exert only a light pressure on the chill member and the fresh layer of metal which has just been deposited on it. The lower roll of this pair may be vibrated or provided with means to impart a rapid sidewise shaking of the composite chill member and the thin layer of metal that has been deposited on it, this vibrating or tapping or sidewise shaking being effected by known means schematically indicated at 51.

One or more convolutions of a conductor 52 surround the lower portion of the syphon discharge terminal 46. This conductor has terminals as indicated in FIG. 7 for connecting it in series with a source of alternating current. Also, the conductor is preferably tubular for the circulation of cooling water therethrough. The field generated by this conductor will prevent the outflow of molten metal between the edges of the discharge terminal and the traveling chill member, including the escape of liquid metal under terminal edge 46*c* where the combined thickness of the chill member and solidified layer formed thereon is less than the clearance space between 46*c* and the upper surface of chill member 47. In fact the conductor and its field may be so adjusted that it will permit some of the still molten metal to be carried out while restraining more than a predetermined depth.

Another such conductor 53 may be positioned around the water-cooled plate 48 to also control or restrain the escape of molten metal around the edges of the syphon discharge terminal.

It should be pointed out that the weight or ferrostatic pressure at the discharge terminal of the syphon is only the weight of the metal which results from the difference between the level of the metal in the supply vessel 44 and the discharge end of the terminal 46, as otherwise, in a syphon barometric pressure balance the height of liquid in one leg against the height in the other.

An incidental value of the syphon is that the chamber 43 being at less than atmospheric pressure, will aid in degassing the metal and gas given off by the metal will be drawn out by suction means (not shown) at 54 without destroying the reduced pressure in chamber 43 necessary to sustain the syphon.

Also, in FIG. 7 there is shown a flat high-frequency induction coil 55 between the discharge terminal of the syphon and the rolls 50. This coil is close to the top surface of the cast layer of metal over the chill surface and is arranged to melt only the surface skin of the layer of metal to a liquid condition. This will aid in removing any surface irregularities on the exposed surface of the cast layer. The cast layer itself may not be subjected to any heavy rolling pressure until its temperature has dropped to a normal hot rolling temperature, and for this reason the rolls 50 exert only a light pressure to remove surface irregularities, and vibration of the traveling form vertically or laterally as above described may aid in leveling the surface of the cast layer where its surface has been inductively heated to a liquid condition.

In FIG. 8 there is disclosed a refractory vessel 60 having side walls 61 and end walls (not shown) so that molten metal to a predetermined depth indicated by the broken line A—A can be maintained. There is a cooled dip roll 62 supported to rotate with a driven shaft 63 in bearings (not shown) so that its periphery at the bottom is immersed in the molten metal in the vessel 60. As the roll rotates, a layer of metal congeals on the surface, as indicated at 64, which layer is thereafter stripped from the surface of the roll at some place above the layer of liquid metal (as shown for example in my copending application Ser. No. 537,561 filed as a continuation of application Ser. No. 337,931, filed March 5, 1973 and which is incorporated by reference to the extent to which it is applicable in this application, and as disclosed in my copending application filed concurrently with this one). In said concurrently-filed application, as in this one, the vessel is surrounded by several turns of a conductor 65 which is in series with a source of alternating current (not shown), the coil extending up and down the side walls of the vessel from a level below the lowest portion of the roll 64 to the surface, or close to the level of the surface, of the molten liquid, here indicated by line A—A.

In my said concurrently-filed application the coil is energized to exclude molten metal from the spaces between the ends of the roll and the side walls. In the instant case the conductor coil is energized so that it not only excludes the metal from these spaces, but also it repels the molten metal from the side walls, inwardly beyond the ends of the dip roll to adjust the width of the congealed layer on the roll to a width less than the length of the roll, as indicated by the layer of congealed metal indicated in section by reference numeral 64.

FIGS. 9 and 10 show the use of conductors connected with a source of polyphase alternating current to effect the flow of metal from a lower level to a higher one, repelling the metal from a trough to which molten metal is supplied up opposing ramps to be solidified against a traveling cold surface as a continuous layer.

As here disclosed there is a refractory body designated generally as 70 having a trough 71 along one side and a similar trough 72 along the other side. Midway between the two troughs the body has two separated elevated platforms 73 and 74, each with an inclined ramp 75 leading from the trough 71 up to the platform and similar ramps 76 leading from trough 72 to the respective platfoms. At each side of each platform and its ramps there is a confining side wall 77. Above each platform there is shown a driven water-cooled roll 78 with a central area 79 that is of substantially the same width as the width of the platform between the two ramps. Driving means (not shown) rotate the rolls in opposite directions so that, as here shown, the lower portions of their peripheries turn away from each other, although in some cases they may move toward each other.

Under each ramp there is a three-strand conductor system 80 so connected to a three-phase source of alternating current as schematically indicated at 81 as to generate a field wherein the conductors 80 will progressively repel molten metal from the troughs 71 and 72 up the ramps to the platforms where it congeals on the surfaces of the rolls 78. The layers of metal so formed on the respective rolls may, as here shown, be brought together at the place of nearest convergence of the roll surfaces and pressed into a single downwardly-traveling strand 82 that emerges from below the refractory body through a passage 84 between the two platforms. Depending on conditions, the layers when they are pressed together, may fuse weld or simply move together to be subsequently separated as thin finished or semi-finished strips.

Molten metal is continuously supplied to one of the troughs 71 as indicated at 85 and some of it is transferred through duct 86 to trough 72 so that the liquid level is the same in both troughs, duct 86 schematically indicating means for effecting such cross-flow. The molten metal is maintained at a depth where it is below the tops of the troughs and extends but part way up the ramps. With the three-strand conductor system under each ramp, the repelling force of the field generated by the polyphase current propels the molten metal up onto the platform area at which the ramp terminates so that molten metal is supplied to opposite sides of each platform to maintain a pool of molten metal on the platform into which the roll above the platform dips. The general arrangement is similar to the use of a traveling field inductor in electromagnetic conveyors. The apparatus as here shown is self-regulating in that metal will be elevated and supplied to the platforms at the rate at which it is removed on the chill surfaces and excess can return, if necessary, through a by-pass (not shown).

In lieu of a cooled roll or rolls, some other traveling element, such as an endless belt or a strip of metal as previously described may be substituted. In this apparatus and method, the conductor is used only to move the metal up a ramp or ramps and it is not employed to repel the metal from entering some space or gap as in previous embodiments.

FIG. 11 shows a refractory body 85 having a molten metal supporting passage 86 that terminates in a vertical passage 87, the top of which opens into a shallow basin 88. Under this basin there is a flat or pancake type of conductor 89 that surrounds the vertical passage 87. There is a second vertical passage 87′ into which the basin overflows, and there is a peripheral overflow channel **88*a* around the edge of the basin that slopes down toward passage 87′ and opens into it. The arrangement is such that metal may overflow the edges of the basin and enter passage 87 to recirculate into passage 86** to mix with the incoming metal.

Spaced above the basin and covering the same is a traveling cold element 90, such as a belt, a rotating drum, or a metal sheet or strip, which may even be a sheet cast from a previous similar sheet metal forming stage.

When the pancake conductor coil is energized, it will lift the molten metal in the basin against the traveling chill surface 90 to deposit thereon a continuous layer of steel 91 which may remain laminated to the element 90, or which is subsequently stripped therefrom as a thin strip of chill zone thickness and density. Spray nozzles are indicated at 92 for cooling the top surface of the traveling chill member to accelerate solidification of a desired thickness of metal.

FIG. 12 shows a modification of the apparatus shown in FIG. 11 wherein the traveling chill is represented as a curved element 95 which may be the surface of a rotating drum, a flexible belt or a previously-solidified strip or layer of metal. The periphery of the curved surface is over a refractory vessel 96 which is supplied with molten metal through inlet port marked 97, and the level of the molten metal is kept constant in the vessel. There is a pancake coil 98, here represented as a water-cooled spiral, with terminals **98*a* and 98*b*, under the vessel, and the level of molten metal is raised when the coil is energized to a level where a layer of metal 99** of the desired thickness will be deposited on the curved chill surface.

FIG. 13 shows another embodiment of the invention where the traveling chill surface 100 is sloped upwardly in the direction of its travel. There is a source of molten metal, which desirably is the discharge leg of a syphon 101 as described in FIGS. 6 and 7. There will be a pool 102 of liquid metal on the chill surface, the extent of which in the direction of upward travel of the chill surface depends on the metalostatic pressure in the discharge terminal of the syphon leg. The higher this pressure, the greater will be the length of the pool 102. The thickness of the solidifed layer of metal that forms on the chill surface depends on the speed of the chill surface and the length of time there is liquid metal over the chill surface. In FIG. 13, the length of the pool of molten metal and therefore the length of the solidified metal, is indicated by dimension *a*. However, there is a system of conductor 103 energized from a polyphase *a–c* current (not shown) and as described in FIGS. 10 and 11 so that the liquid metal would be only equal to dimension *b*, or by reversing the direction of the field the pool may be lengthened. Also, instead of a polyphase conductor, the length of the pool may be shortened by using a coil similar to FIG. 3 or FIG. 4 or both together. In such case the field is also effective to prevent the escape of metal at the lower edge of the syphon terminal and the side edges.

FIG. 14 discloses schematically a method and apparatus where an electromagnetic field may be used to prevent the liquid metal, as it solidifies, from sticking to the chill surface. This is accomplished by levitating the liquid metal in the initial portion, at least, above the chill surface, to form an air gap between the chill surface and the molten metal while a thin crust continuously forms on the under surface of the molten metal by radiation of heat from the hot metal to the chill surface. Beyond this point the thin crust lowers onto the traveling chill surface and draws the continuously forming new crust or skin with it.

In FIG. 14 the molten metal 105 is in a discharge terminal 106, such as the discharge terminal of the down leg of a syphon as described, for example, in FIGS. 6 and 7. The traveling belt or other means providing a chill surface over which the molten metal solidifies is designated 108.

There is a conductor or winding 109 for connection in series to a source of alternating current under the discharge terminal 106 at the place where the chill surface first moves under the molten metal in said terminal. Below the conductor is a magnetic core 110 of laminated metal and of a length slightly longer than the coil 109 so that it generates a field that arches up through the molten metal, as indicated, repelling the molten metal from direct contact with the traveling chill surface, with a thin air gap between the metal and the chill surface. This causes a thin skin of solidified metal to initially form at the under surface of the molten metal which continuously lowers onto the chill surface beyond the magnetic field, and the newly-formed skin is thus continuously pulled by the previously-formed skin out of the magnetic field to rest on the traveling chill surface.

Spray means 111 under the traveling chill member 108 cools it and there is a non-magnetic shield 112 which prevents the spray water from wetting the coil 109 or magnet 112. A conductor 113 at the exit side of the terminal 106 allows the chill member with the solidified metal thereon to move from beneath the terminal 106 but prevents the outlfow of molten metal. A similar conductor 114 (or a portion of the same conductor) can be placed around the entering side of the syphon terminal and at each end of said terminal to prevent outflow of liquid metal or formation of fins at these places, as hereinbefore explained.

While the winding 109 may comprise a simple water-cooled conductor, a traveling field generating winding as previously described energized from a polyphase current will assist the moving of the initial skin of solidified metal in the direction of travel of the belt or like traveling chill member 108. In the drawing 109 is a schematic representation of either type of coil.

FIGS. 15, 16 and 17 disclose an arrangement where the molten metal may be solidified on a vertically-moving or steeply-inclined chill surface, and it also discloses how the solidified layer may be thicker in the central area than along the two margins.

In these figures 120 indicates an endless belt designed to provide a traveling chill surface. It passes over an upper roll 121, extends diagonally down to and around a second roll 122, then at a slight incline, but generally horizontally around a third roll 123 vertically up to the first roll 121.

There is disclosed a refractory enclosure 124 in the form of a vertically-elongated trough with an open face confronting and bearing against the vertical reach of the belt intermediate the upper and lower rolls. Molten metal is supplied to this trough through a duct 125, the arrangement being such that the molten metal in the trough will contact and solidify on the traveling belt which covers and moves over the open face of the trough-like container. There is a hollow water-cooled plate structure 126 on the opposite side of the belt for confining the belt in position against the open face of the enclosure 124 and accelerating solidification of molten metal. Its width is equal only to the width of the refractory enclosure, which does not extend over the margins of the belt.

There is a yoke-like conductor 127 of two or more convolutions extending down one side of the enclosure 124, across its lower end and up the other side, closely conforming to the contour of the enclosure 124. It is preferably comprised of water-cooled tubing with an inlet at one end and an outlet at the other end and is designed to be energized by applying alternating current to its opposite terminals from a source (not shown). The conductor is at the plane where the side and bottom edges of the enclosure have a working clearance with the belt, and the field which it generates prevents molten metal from escaping between the belt and the side and bottom edges of the refractory enclosure in the manner previously explained. Since gravity prevents escape of molten metal across the top edge of the enclosure which is spaced from the belt sufficiently to allow the belt with a maximum layer of solidified metal adhering thereto, no conductor is needed across the top of the enclosure in the proximity of the belt.

In FIGS. 15, 16 and 17 the layer of solidified metal formed on the belt is designated 130. It is separated from the belt by means, such as a wedge 131 at the point where the belt passes around roll 121, and means (not shown) draws the cast sheet upward.

After passing over roll 121 the belt passes through an enclosed spray chamber 132 where any adhering foreign matter will normally be removed. There is a rotary brush 133 below the spray chamber bearing against the chill-forming surface of the belt to further insure removal of adhering foreign matter. Finally at 134 there is a rubber strip or squeegee to remove any liquid from this surface. At 135 the belt passes through a leveler 136 to remove any slight bends or kinks. At 137 there is a means for coating the chill surface of the belt with a release compound to prevent the molten metal from permanently adhering to the chill surface, and facilitate stripping of the formed thin layer at $13^1$. Rolls for flattening and smoothing the thin cast sheet while it is still quite hot are shown at 138.

Referring particularly to FIG. 16, it will be noted that the enclosure 124 has a lower portion 124*a*, an intermediate portion 124*b* with outwardly-flaring sides, and a portion 124*c* at the top having substantially parallel sides which is of maximum width. Keeping in mind that the speed of travel of the belt and the distance which it is exposed to the molten metal, this contour of the enclosure results in the central portion 130*a* of the cast sheet or strip being thicker than the two margins 130*b* which taper in thickness from the maximum along the center outwardly toward the edges (see FIG. 17).

As above stated, enclosure 124 is not as wide as the belt so that the full width of the strip 130 is less than the width of the belt. This is shown in the drawings where the margins at each side of the belt, designated 130*c* (FIG. 16) are not covered by the solidifed sheet or strip. To avoid or reduce the effect of unequal heating, fuel burners 139 (see FIG. 15) are arranged just below the enclosure 124 at each side of the enclosure for directing a flame against these margins, but for clarity of illustration they have been omitted from FIG. 16.

In this embodiment it will be observed that the length of the area of contact of the molten metal with the moving chill surface across the width of said surface varies to vary thickness crosswise of the strip at different areas and is made possible by contouring the conductor 127 to the contour of the molten metal enclosure or container 124, since this conductor regulates the lateral spread of the molten metal with the increase in width of the enclosure as well as preventing the liquid metal from running down the approaching vertical chill surface as leakage under the edge of the enclosure. This same variation of thickness may be secured where the chill surface is horizontal, as by contouring the discharge terminal of the down-leg of the syphon as hereinbefore described.

The invention is not restricted to the foregoing specific disclosures illustrating schematically typical embodiments of the invention, and modifications or arrangements shown in one example may, where applicable, be used in another. For example, burners to reduce or prevent distortion as disclosed in FIG. 15 may also be used in other embodiments where this may be desirable or beneficial.

It is not possible to specify the exact extent and frequency of the alternating current field, or where used, the extent and frequency of the current for energizing an electromagnet, and of course known methods of converting direct current to alternating current are applicable. The repelling effect results from the eddy currents induced in the molten metal by the electromagnetic field generated by the alternating current flowing through the conductor, these induced currents reacting with the field which generates them. In general the strength and frequency of the energizing current must be related to the electric resistance of the liquid metal and of other intervening media, such as the traveling belt located between the molten metal and the conductor. As a rule the lower frequency, the greater the magnetic field penetration (reference depth). Accordingly too low a frequency may cause an undesirably vigorous agitation of the pool of liquid metal, while too high a frequency may generate eddy currents where too much heating of the molten metal, and perhaps adjacent equipment, may result. Sometimes currents of more than one frequency and strength may be combined.

Certain known formula may assist one skilled in the art to be utilized, but will not be strictly applicable because in some equipment eddy current losses cannot be accurately calculated in advance. According to known formula the force (K) per kg/cm² by an induced power *P K W* is:

$$K = 31.6 \frac{P}{F} \sqrt{\frac{u}{pf}} \text{kg/cm}^2$$

where:

$u$ = permeability $p$ = specific electric restivity in $$\frac{\text{Ohms}}{m} \text{mm}^2$$

$f$ = frequency in Hertz $F$ = the surface in cm² "covered" by the inductor

Thus, for example, a repelling force of 0.014 kg/cm² is required for balancing a column of liquid steel 2 cm high with a specific weight of 7, the induced power has to be:

$$P - \frac{0.014}{31.6 \sqrt{\frac{u}{pf}}}$$

Assuming that both permeability ($u$) and resistance ($p$) are 1, the induced power should be 3.14 Watt/cm² when the frequency is 50 cycles per second, whereas at a frequency of 10 cycles per second the induced power $P'$ is only 1.4 Watt/cm².

However, the penetration depth (i.e. reference depth or skin effect) also increases with decreasing frequency according to the formula:

$$d = 50.3 \sqrt{\frac{p}{uf}}$$

For the proper choice of frequency of current charged to the winding or conductor the unavoidable generation of eddy currents in parts affected by the magnetic field must also be taken into consideration. The size, i.e., capacity of these parts should be less than the reference depth of the magnetic field.

In cases where the meniscus of the liquid pool is elevated above the walls of the container by the action of the electromagnetic force, as in 4 and 5 and 11 and 12, a lower frequency will be more appropriate than a higher one. The higher one may be more appropriate where the effect of the field is to repel metal from a cap area between fixed and moving parts. However, the eddy currents produced in the molten metal will generate heat which may be desirable where too rapid loss of heat may otherwise occur. If this generation of heat is more than that desired, it may be more practical to operate with currents of more than a single frequency than to attempt to select one frequency.

The continuously moving member on which the metal solidifies is herein variously designated the traveling chill member or moving chill surface and is so designated because it is designed to cool the molten metal with the rapidity which molten metal initially solidifies against the surface of a mold. For the best quality of metal resulting from rapid cooling and solidification, steel is desirably of a thickness ranging from 2 mm to 5 mm but it may be thicker depending on the metal and rate of cooling and the subsequent use to which the sheet or strand is to be put. In my copending application Ser. No. 537,561 filed as a continuation of Ser. No. 337,931; which was filed Mar. 5, 1973, and which to the extent that may be relevant is incorporated herein by reference, there is disclosed the fusing of one such layer or strand upon another to form a semi-finished product for subsequent rolling or forging, and according to the present invention such a product may be formed and a previously-formed strand may be used to provide the traveling chill surface on which a subsequent layer of metal is solidified and permanently fused thereto.

As pointed out herein, the traveling or moving chill surface may comprise a cooled roll, an endless belt or an elongated strip of metal moving off one roll onto another. It may be copper or other non-magnetic material, or if magnetic, so formed or arranged as to offer minimum absorption of the repelling force of the field generated by the conductor energized from an A-C source, but it may even be a previously-formed layer of the same metal. It may be a net covered with a refractory mineral, such as asbestos, or it may be formed in a known manner from a succession of plates hinged to one another to flex but when flat provide a continuous surface. Also the chill surface may have slight riffles or grooves, less than 1 mm in depth or width thereover which will generally result in an improved surface in the resulting product due to a complex relation between hydrostatic pressure and surface tension. Surface tension tends to prevent the molten metal from penetrating the grooves while hydrostatic pressure, where there are no grooves, tends to result in breakthroughs in the solidifying metal at the meniscus where the molten metal first solidifies. This results in scars in the casting. The provision of the slight grooves or riffles which the molten metal bridges tends to flatten this meniscus and reduce the formation of scars. Also they may frequently prevent the entrapment of gases which may subsequently puncture the solidifying metal if not relieved.

In each of the several embodiments herein disclosed the electromagnetic field is used to control or regulate in some way the supply to or spread of the molten metal on the continuously-moving chill surface. In FIGS. 1 to 3 the field restrains liquid metal being forced upward by metalstatic pressure from escaping from the exit side of the tundish along with the layer of solidified metal. In FIGS. 4 and 5 and 11 and 12 the electromagnetic field also serves this function and in addition raises the level of the metal above the level in the supply well against the moving chill surface. In FIGS. 6 and 7 and 14 the electrostatic field operates against gravity to regulate or govern the downflow of metal from a syphon onto a moving chill surface. In FIG. 8 the electrostatic field forces the liquid metal inwardly beyond the edges of a dip roll to limit the width of the solidified metal to less than the axial length of the roll. In FIGS. 9 and 10 a moving electromagnetic field effects the feeding of the molten metal up an inclined slope to an elevated surface for contact with the moving chill surface. Such a field is also used in FIG. 13 to shorten or increase the length of the molten metal pool on an inclined moving surface to decrease or increase the thickness of the layer of solidified metal on the inclined surface and, as explained above, in FIGS. 15–17 the thickness of the strand or strip crosswise of the chill surface is controlled by the electrostatic field.

I claim:

1. An apparatus for continuously forming a thin strand of solidified metal directly from molten metal wherein there is a. a receptacle to which molten metal is supplied;

b. a continuously-moving means so arranged with reference to the receptacle as to present a continuously-moving cold surface to the molten metal in the receptacle onto which the metal progressively solidifies in a thin continuous strand, and c. a conductor means energized from an alternating current source for predetermining the area of contact between the molten metal and the moving cold surface.

2. The apparatus defined in claim 1 wherein means is provided for separating the thin solidified strand from the surface of said continuously-moving means.

3. An apparatus defined in claim 1 in which the said conductor means is arranged to predetermine the area of contact crosswise of the moving cold surface between the molten metal and the said surface.

4. An apparatus defined in claim 1 in which the said conductor means is arranged to predetermine the area of contact lengthwise of the moving cold surface between the molten metal and the said surface.

5. An apparatus defined in claim 1 wherein the conductor means is energized from a polyphase current and is constructed to propel the metal lengthwise of the continuously-moving chill surface to increase or decrease the length of the surface contacted by the molten metal.

6. The apparatus defined in claim 5 in which the receptacle is positioned above a continuously-moving upwardly-sloping surface and arranged to form a pool of molten metal on said surface of decreasing depth in the direction of travel of said surface, the said conductor means being positioned under said surface where it may control the extent and depth to which the pool extends beyond the receptacle.

7. The apparatus defined in claim 6 in which the endless belt with oppositely-moving runs and the receptacle has an open top with one of said runs of the belt moving across the top of the receptacle between and entering side of the receptacle and an exit side, the receptacle providing clearance on the exit side at the top for the solidified layer of metal that forms on the under surface of said run and the conductor means is arranged to restrict the outflow of molten metal from the receptacle at the side of the receptacle along with the solidified strand of metal that forms on the belt.

8. An apparatus as defined in claim 6 in which said continuously-moving means is an endless belt and the receptacle has an open face across which the belt moves, with the molten metal in the receptacle contacting the belt.

9. The apparatus defined in claim 7 in which the endless belt has oppositely-moving runs and the receptacle has an open bottom across which one run of the belt moves from an entering side to an exit side, the receptacle having a wall on its exit side with reference to the direction of travel of said run of the belt providing clearance for the strand of metal that forms on the belt, said conductor means being arranged to restrict the outflow of molten metal carried away from the receptacle on the belt.

10. The apparatus defined in claim 1 in which the receptacle has an open lower end and is positioned over the continuously-moving cold surface and said surface moves across the open lower end of the receptacle so that the molten metal is deposited on the cold surface, the said conductor means being constructed to control the area and thickness of the molten metal which is congealed onto the cold surface.

11. The apparatus defined in claim 10 in which the receptacle comprises a down-leg of a syphon, the up-leg of which is immersed in a vessel to which molten metal is supplied for transfer to the down-leg.

12. The apparatus defined in claim 11 in which the upper ends of the two legs open into a common chamber, and means is provided for withdrawing gases from said chamber, whereby the molten metal may be degassed while flowing through the syphon.

13. The apparatus defined in claim 1 in which the continuously-moving means is a cooled roll.

14. An apparatus as defined in claim 1 in which a conductor means also is arranged to regulate the supply of molten metal to the receptacle for controlling the thickness of the solidified continuous strand.

15. The apparatus defined in claim 1 in which the said continuously-moving means which provides the moving cold surface is circularly curved in the area where it contacts the molten metal.

16. The apparatus defined in claim 7 wherein the open face of the receptacle across which the belt moves has at least one portion across the width of the belt that is longer in the direction of travel of the belt than another portion whereby the resulting strand has at least one portion crosswise of its width which is thicker than another portion.

17. The apparatus defined in claim 16 in which the longer and shorter portions of the open face of the receptacle are connected by an area that increases in width angularly both crosswise and lengthwise of the belt whereby the strand tapers in thickness from the thicker portion downwardly to the thinner portion.

18. The apparatus defined in claim 1 in which the receptacle is open at the top and said continuously-moving means is arranged to provide a continuously-moving cold surface across the open top of the receptacle wherein the conductor means has a portion which surrounds the receptacle and which is effective to raise the level of the molten metal against the continuously-moving cold surface.

19. A method for producing a continuous flat strand directly from molten metal wherein a continuously-moving cold surface is brought into contact with the molten metal and an electromagnetic field is generated in the area of contact between the moving cold surface and the molten metal in such a manner as to induce eddy currents in the molten metal to control the area over which the molten metal will spread over and solidify on the moving cold surface.

20. The method as defined in claim 19 wherein the electromagnetic field progresses unidirectionally in cycles to the molten metal to effect a flow of the molten metal in a predetermined direction.

21. The method defined in claim 20 in which the flow of the metal is selected relatively to the moving cold surface to regulate the thickness of the continuous strand by controlling the length of contact between the molten metal and the moving cold surface.

22. The method defined in claim 19 in which the continuously-moving cold surface travels above a receptacle to which the molten metal is supplied and the electromagnetic field is arranged to exert an upward pressure of the molten metal against the under side of the moving cold surface.

23. The method defined in claim 19 in which the continuously-moving cold surface travels across a discharge terminal at the lower end of the down-leg of a syphon arranged to transfer molten metal from a receptacle to which the molten metal is supplied to the upper side of the continuously-moving cold surface and the electromagnetic field regulates the outflow of molten metal from said discharge terminal onto the moving cold surface.

24. The method defined in claim 19 in which the length of contact of the molten metal with the moving cold surface is longer in the direction of travel of the cold surface on one portion across the width of the moving cold surface than at another portion to vary the thickness of the strand in said portions crosswise of the width of the moving cold surface.

* * * * *